US007377402B2

(12) United States Patent
Takeda

(10) Patent No.: US 7,377,402 B2
(45) Date of Patent: May 27, 2008

(54) ARTICLE TRANSFER DEVICE

(75) Inventor: Kengo Takeda, Tokyo (JP)

(73) Assignee: Aruze Corp., Tokyo (JP)

( * ) Notice: Subject to any disclaimer, the term of this patent is extended or adjusted under 35 U.S.C. 154(b) by 279 days.

(21) Appl. No.: 11/081,699

(22) Filed: Mar. 17, 2005

(65) Prior Publication Data

US 2005/0205503 A1 Sep. 22, 2005

(30) Foreign Application Priority Data

Mar. 18, 2004 (JP) ..... 2004-078479

(51) Int. Cl.
*A47F 1/00* (2006.01)

(52) U.S. Cl. ..... 221/312 A; 221/213; 221/214; 221/155

(58) Field of Classification Search ..... 221/213, 221/214, 312 A
See application file for complete search history.

(56) References Cited

U.S. PATENT DOCUMENTS 3,248,005 A * 4/1966 Joschko ..... 221/277
4,638,922 A * 1/1987 Stoltz ..... 221/281

FOREIGN PATENT DOCUMENTS

| | | |
|---|---|---|
| JP | 10-116386 | 5/1998 |
| JP | 2001-076242 | 3/2001 |
| JP | 2002-150397 | 5/2002 |
| JP | 2002-157641 | 5/2002 |

* cited by examiner

*Primary Examiner*—Gene O. Crawford
*Assistant Examiner*—Timothy R Waggoner
(74) *Attorney, Agent, or Firm*—Leydig, Voit & Mayer, Ltd.

(57) ABSTRACT

An article transfer device which transfers articles using hanger rods each of which includes helical ridges or helical grooves, wherein the article transfer device can ensure a sufficient number of articles to be suspended without increasing depth of the housing. In an article transfer device which include hanger rods, each of which forms helical ridges and has a length sufficient to allow the suspending of articles therefrom, a support which supports the respective hanger rods for rotation about respective axe, a driver which rotates the respective hanger rods, and a housing which accommodates the respective hanger rods, the support and the driver therein. Each hanger rod has a pitch enlarged portion where pitch of the helical ridges is larger than in other portions so the direction of the suspended article can be changed.

4 Claims, 11 Drawing Sheets

ARTICLE TRANSFER DEVICE

CROSS-REFERENCES TO THE RELATED APPLICATIONS

This application is based upon and claims the priority from a prior Japanese patent application No. 2004-078479, filed on Mar. 18, 2004, in Japan, entire contents of which are incorporated herein by reference.

This application is related to a U.S. patent application referred to as a prior Japanese patent application No. 2004-078524 filed in Japan on Mar. 18, 2004.

BACKGROUND OF THE INVENTION

1. Field of the Invention

The present invention relates to an article transfer device which transfers articles such as commodities, display products or the like in a suspended manner.

2. Related Art

Conventionally, there has been known an article transfer device which transfers articles such as commodities, display products or the like in a suspended manner. For example, there has been known a vending machine in which commodities are suspended from hanger rods each of which includes helical ridges or helical grooves which extend spirally or helically along an axis thereof, the hanger rods are rotated about axes thereof thus transferring the commodities while guiding the commodities using the helical ridges or the helical groove and allowing the falling and the takeout of the commodities. With respect to this type of vending machine, conventionally, in Japanese laid-open Patent Publication Hei10 (1998)-116386, for example, there has been disclosed a vending machine in which helical racks which sequentially shorten lengths thereof from above to below are arranged vertically and commodity holding lugs which hold thin commodities such as gift coupons on each helical rack are suspended and transferred.

SUMMARY OF THE INVENTION

However, the article transfer device which transfers the articles such as commodities or the like using the hanger rods having the helical ridges or the helical grooves including this type of vending machine has following drawbacks conventionally.

The hanger rods and constitutional elements such as a motor for rotatably driving the hanger rods which are served for the transfer of articles are accommodated in a housing. To accommodate the plurality of hanger rods in the inside of the housing, a plurality of hanger rods are arranged vertically or horizontally with an interval which is determined by taking a size of the articles to be suspended into consideration.

However, although each hanger rod includes the helical ridges or the like which transfer articles thereon, since the helical ridges have a helical shape, the helical ridges are arranged obliquely with respect to an axis of the hanger rod. When the articles are suspended from the hanger rod, since the articles are also guided by the helical ridges or the like, the articles are arranged in the direction along the helical ridges or the like. Accordingly, to observe a state in which a plurality of packed articles which are packed in boxes are suspended from the hanger rod from a front surface of the housing, the directions of the boxes of respective articles are not directed toward the front surface of the housing and are arranged obliquely from the axis of the hanger rod and hence, it is difficult to observe a front surface of the article. To avoid such a drawback, there has been proposed an idea in which an arrangement pitch of the helical ridges in the hanger rod is widened thus facilitating the change of the directions of the respective articles whereby the directions of the respective articles can be observed.

However, when the arrangement pitch of the helical ridges is broadened, the number of articles to be suspended from each hanger rod becomes small and hence, to ensure the sufficient number of articles to be suspended from the respective hanger rods, it is necessary to elongate the length of the hanger rods. In this case, it is necessary to increase a depth of the housing resulting in the enlargement of a space necessary for installing the article transfer device.

On the other hand, when the arrangement pitch of the helical ridges is narrowed, it is difficult to rectify the directions of the respective articles. Further, since the articles come close to each other, when the article which is suspended from a distal end of the hanger rod is removed from the hanger rod, the article is brought into contact with the succeedingly fed article thus giving rise to a drawback that flaws are formed on a surface of the article.

Accordingly, the present invention has been made to overcome the above-mentioned drawbacks and it is an object of the present invention to provide an article transfer device which transfers articles using hanger rods each of which includes helical ridges or helical grooves, wherein the article transfer device can ensure the sufficient number of articles to be suspended without increasing a depth of a housing and hence, the observation of a front surface of the article is facilitated and, surfaces of the articles are prevented from the formation of flaws.

To overcome the above-mentioned drawbacks, the present invention provides an article transfer device which includes a plurality of hanger rods each of which has a length sufficient to allow the suspending of a plurality of articles therefrom and forms helical ridges or helical grooves which extend helically along an axis thereof on a surface thereof; a supporter which supports the respective hanger rods such that the hanger rods are rotatable about respective axes thereof; a driver which rotates the respective hanger rods on the respective axes thereof; and a housing which accommodates the respective hanger rods, the supporter and the driver therein, wherein each hanger rod has a pitch enlarged portion where an arrangement pitch of the helical ridges or the helical grooves is set larger than the arrangement pitch of the helical ridges or the helical grooves in other portions thereof, and the pitch enlarged portion is formed on an open-end portion side of the hanger rod which is not supported by the supporter.

In this article transfer device, since the pitch enlarged portion is formed on the open end portion side, the articles which are suspended therefrom can have the directions thereof changed to face a front surface of the housing and, at the same time, an interval between the neighboring articles can be broadened. Further, since the pitch enlarged portion is formed on the open-end-portion side of each hanger rod, the sufficient number of articles to be suspended can be ensured at portions of each hanger rod other than the open-end portion.

BRIEF DESCRIPTION OF THE DRAWINGS

FIG. 5A and FIG. 5B are views showing a hanger rod and a commodity which is suspended from the hanger rod, wherein FIG. 5A is a perspective view with a part omitted of the hanger rod and the suspended commodity and FIG. 5B is a side view showing the hanger rod and the suspended commodity;

FIG. 8A and FIG. 8B are views schematically showing article transfer devices, wherein FIG. 8A is a plan view schematically showing the article transfer device shown in FIG. 1 and FIG. 8B is a plan view schematically showing another article transfer device according to this embodiment;

FIG. 9A and FIG. 9B are views showing articles which are suspended from the article transfer devices according to this embodiment, wherein FIG. 9A is a front view showing a commodity suspended by the article transfer device according to this embodiment and FIG. 9B is a front view showing a commodity suspended from a conventional article transfer device;

DESCRIPTION OF THE PREFERRED EMBODIMENTS

Figure 1:
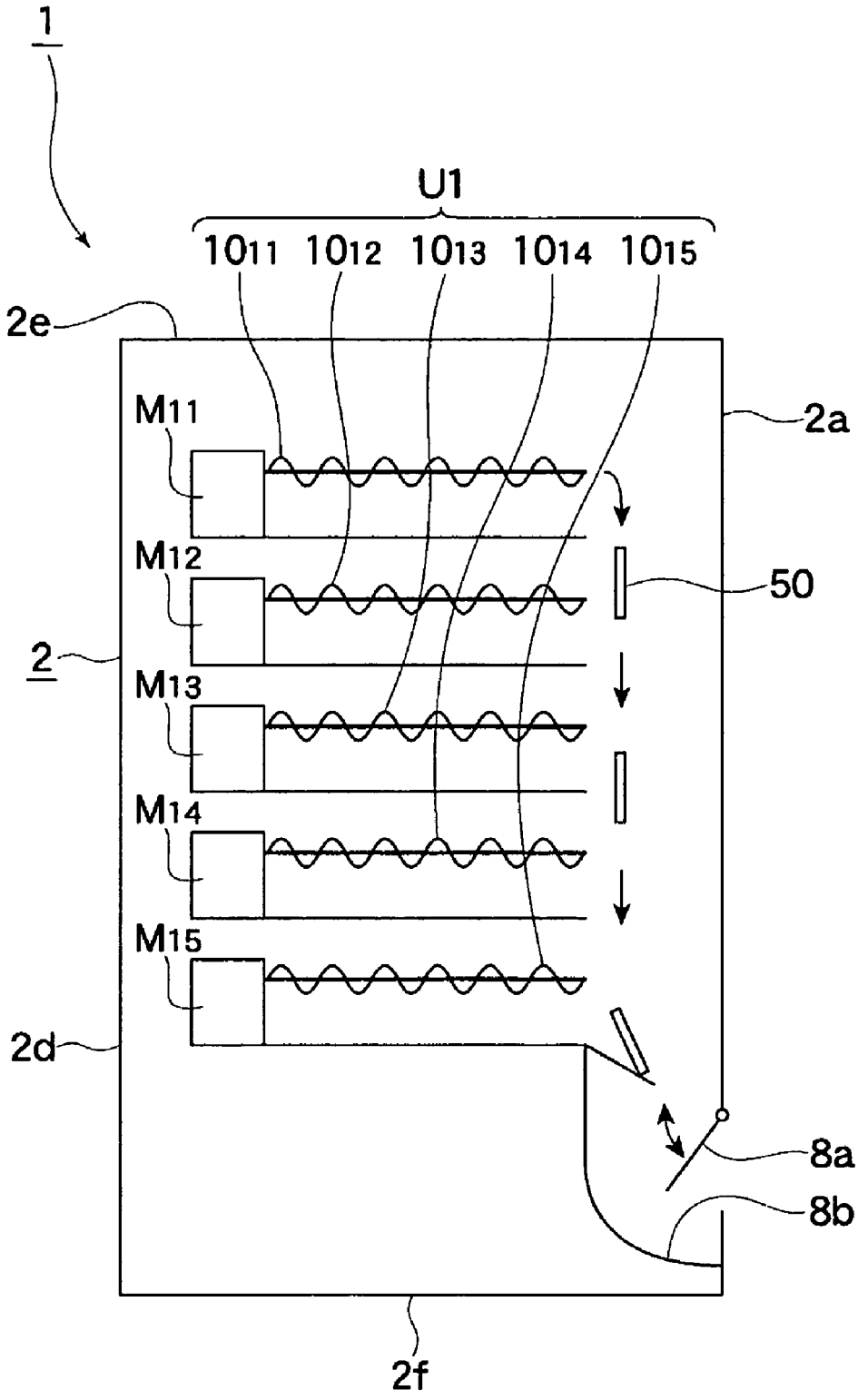
FIG. 1 is a side view schematically showing an essential part of an article transfer device according to one embodiment of the present invention.
Figure 2:
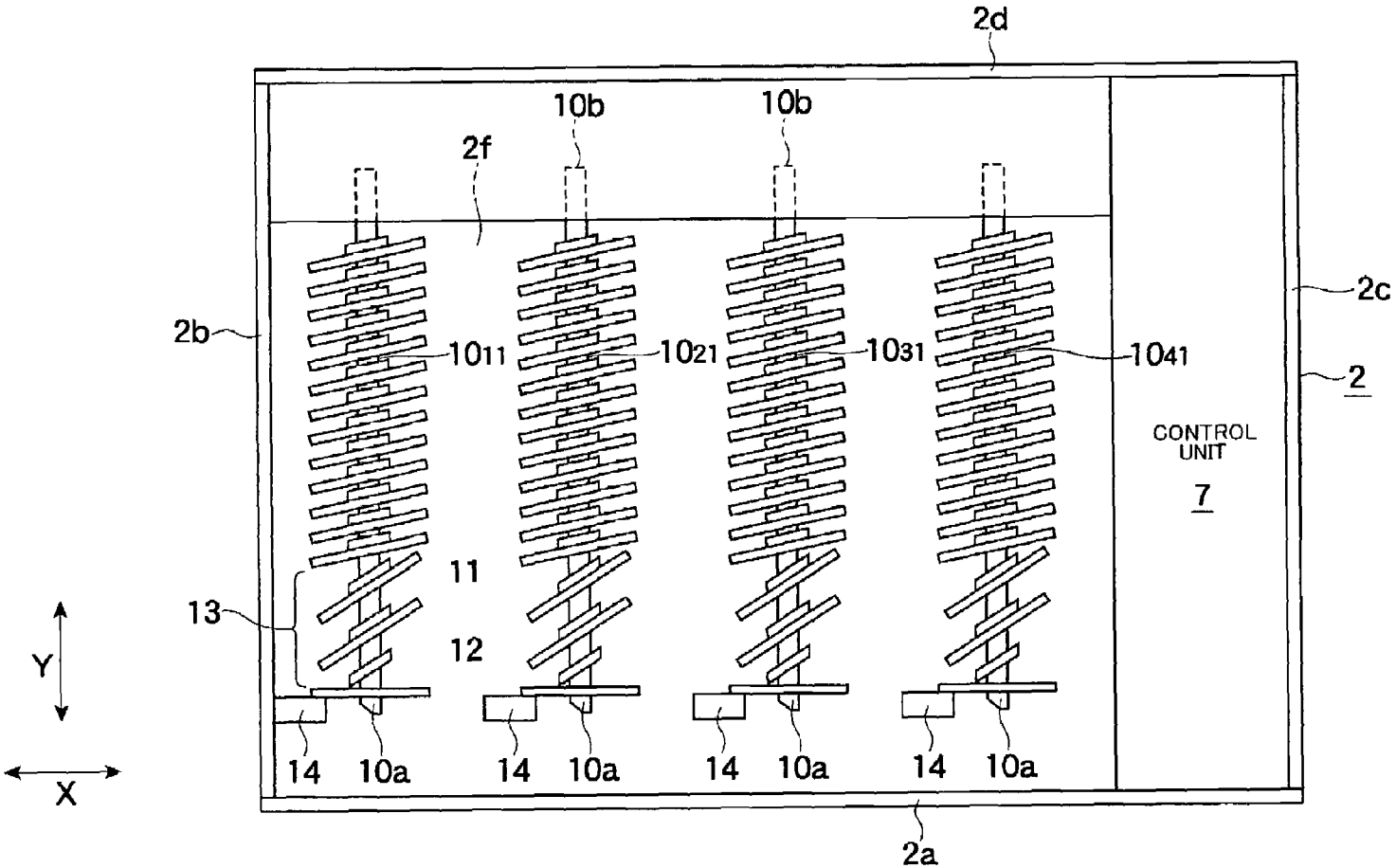
FIG. 2 is a plan view schematically showing an essential part of the article transfer device according to the embodiment of the present invention.
Figure 3:
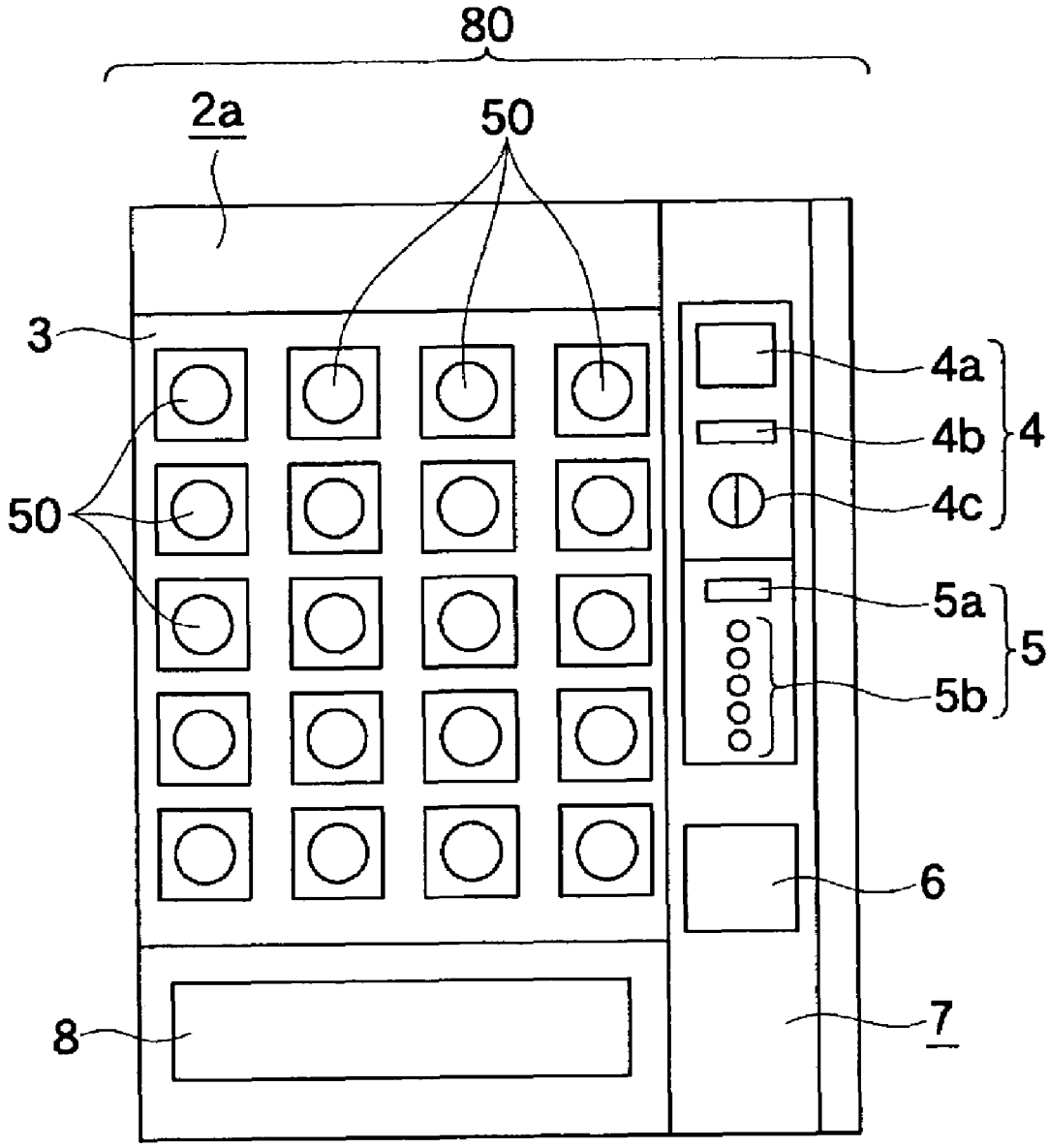
FIG. 3 is a front view schematically showing an essential part of the article transfer device according to the embodiment of the present invention.

Hereinafter, embodiments of the present invention are explained. Here, same symbols are used to indicate identical elements and their repeated explanation is omitted. (overall constitution of the article transfer device) FIG. 1 is a side view schematically showing an essential part of an article transfer device 1 according to one embodiment, FIG. 2 is a plan view schematically showing an essential part of the article transfer device 1 according to the embodiment and FIG. 3 is a front view schematically showing an essential part of the article transfer device 1 according to the embodiment. This article transfer device 1 constitutes a vending machine in which from a plurality of respective hanger rods 10 ($\mathbf{10}_{21}$, $\mathbf{10}_{31}$, $\mathbf{10}_{41}$ and the like) described later, as articles, a plurality of packaged commodities 50 in which DVD (Digital Versatile Disc), CD (Compact Disc) and the like are packaged can be suspended, wherein upon insertion of the coins, each hanger rod 10 is rotated so as to transfer respective commodities 50 suspended from each hanger rod thus falling the commodities 50 and the fallen commodities 50 can be taken out.

The article transfer device 1 includes a housing 2. In the inside of the housing 2, the plurality of hanger rods 10, drive devices 21 to 24 which are served for rotating the respective hanger rods 10 about axes thereof, and other respective constitutional elements described later are accommodated.

The housing 2 includes a face panel 2*a* which constitutes a front surface, left and right side panels 2*b*, 2*c*, a back panel 2*d*, and a top panel 2*e* and a bottom panel 2*f*, wherein in the inside of a rectangular parallelepiped space defined by these panels, the constitutional elements such as the plurality of hanger rods 10 are accommodated.

As shown in FIG. 3, the face panel 2*a* is formed of an acrylic plate, a glass plate or the like for allowing the viewing of the commodities 50 which are suspended from the respective hanger rods 10 with naked eyes, wherein the face panel 2*a* includes a commodity display unit 3 formed of a transparent flat panel, a control unit 7 and a commodity take out opening 8.

The commodity display unit 3 includes, on a rear-side thereof, a hanger rod unit U1 which includes five hanger rods 10 ($\mathbf{10}_{11}$ to $\mathbf{10}_{15}$) which are arranged in parallel vertically. Further, in the commodity display unit 3, in the same manner as the hanger rod unit U1, hanger rod units U2, U3, U4 which respectively include hanger rods $\mathbf{10}_{21}$ to $\mathbf{10}_{25}$, hanger rods $\mathbf{10}_{31}$ to $\mathbf{10}_{35}$ and hanger rods $\mathbf{10}_{41}$ to $\mathbf{10}_{45}$ (see FIG. 4) which are arranged in parallel vertically are arranged in parallel laterally. Here, the respective commodities 50 which are suspended from the respective hanger rods of the respective hanger rod units U1 to U4 can be observed from the outside with naked eyes. In the respective hanger rod units U1 to U4, five hanger rods 10 are arranged in a row at a given interval in the vertical direction. Here, FIG. 1 illustrates the hanger rod unit U1 and, on the rear side of the commodity display unit 3, the hanger rod units U2, U3, U4 having the substantially same constitution are arranged laterally.

The control unit 7 is arranged on the right side of the article display unit 3 and includes a money insertion part 4, a commodity selection part 5 and a change discharge part 6 which are arranged in order from above. The money insertion part 4 includes an amount display portion 4*a*, a bill insertion opening 4*b* and a coin insertion opening 4*c*. The amount display portion 4*a* includes a liquid crystal display device which displays an amount of money which a person who wants to purchase a commodity 50 (hereinafter referred to as "purchaser") inserts. A bill identifying device 4*d* (see FIG. 6) described later is incorporated in the bill insertion opening 4*b*. The coin insertion opening 4*c* is configured to allow the purchaser to insert coins and is connected with first and second coin selectors 4*e*, 4*f* described later.

The commodity selection part 5 constitutes a selection means in the present invention and is served for inputting information necessary for identifying a commodity which the purchaser wants to purchase among the commodities 50 which are suspended from the respective hanger rods 10. The commodity selection part 5 includes a unit designation part 5*a* for designating any one of the hanger rod units U1 to U4 and a number designation part 5*b* which designates the hanger rods 10 (numbers 1 to 5 being attached to the hanger rods 10) in each one of hanger rod units U1 to U4. The change discharge part 6 discharges the change of money which the purchaser inserts. The commodity takeout opening 8 includes, as shown in FIG. 1, an open/close door 8*a* which can be pushed up and an accommodating portion 8*b* which accommodates the commodity 50 fallen from the hanger rod 10. By pushing up the open/close door 8*a* from the outside of the housing 2, it is possible to take out the commodity accommodated in the accommodating portion 8*b*.

Twenty hanger rods 10 in total are arranged such that five hanger rods 10 are allocated to each one of hanger rod units U1 to U4. Each hanger rod 10 forms, as shown in FIG. 2, an open-end portion 10*a* on a face panel-2*a* side and a support end portion 10*b* on a back-panel-2*d* side. Further, the support end portions 10*b* are rotatably supported using drive devices 21 to 24 such that the hanger rods 10 are rotatable about axes thereof in each one of hanger rod units U1 to U4.

Due to such a constitution, even when the article transfer device 1 includes a plurality of hanger rods 10, it is possible to feed the suspended commodity 50 by selecting each hanger rod 10 and by rotating the selected hanger rod 10.

Figure 4:
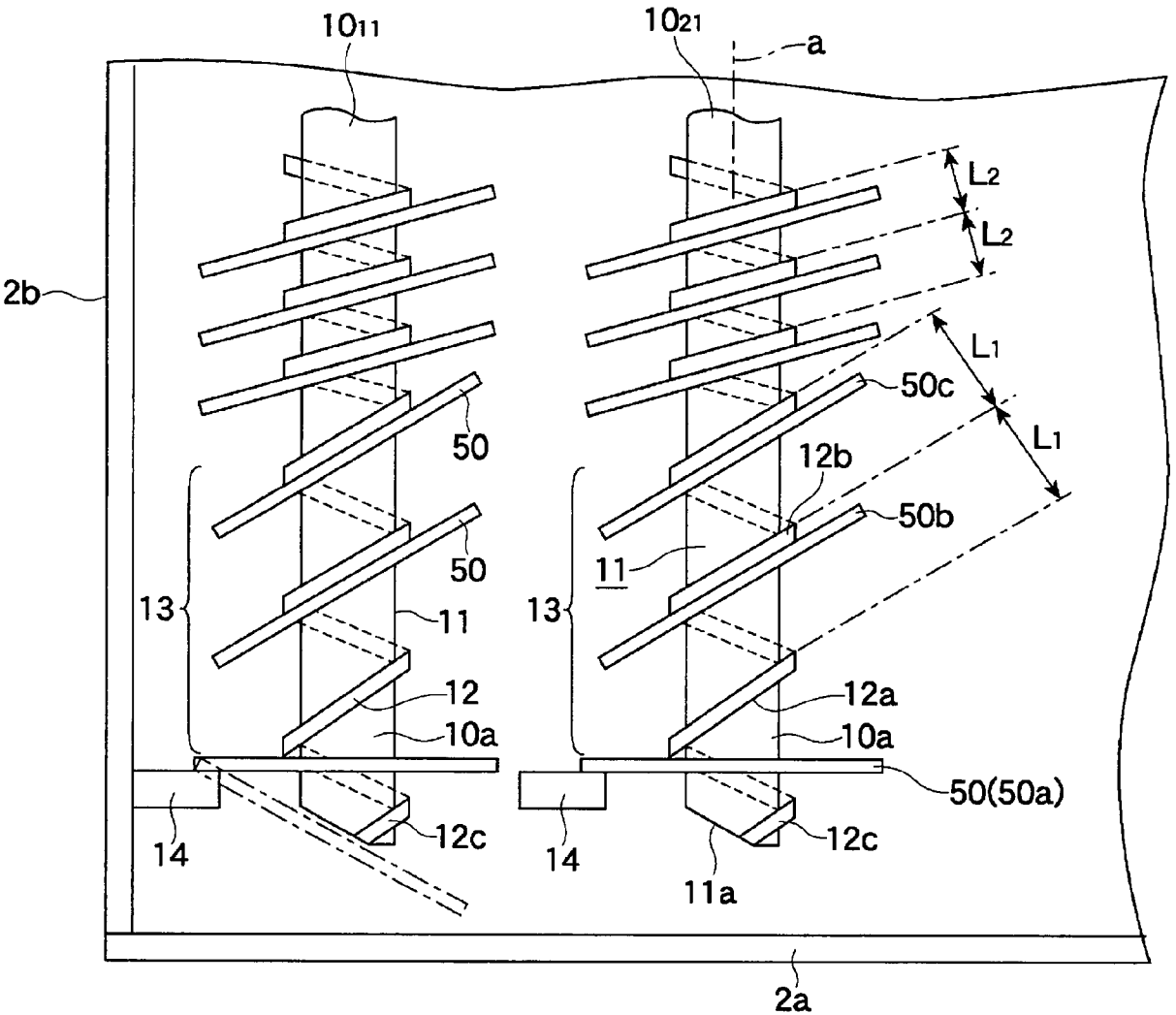
FIG. 4 is a partially enlarged view of FIG. 2.

Further, as shown in FIG. 2 and FIG. 4 which show a portion of FIG. 2 in an enlarged manner, the respective hanger rods 10 (the hanger rods 10 which are arranged at the same height and in parallel to each other within the hanger rod units U1 to U4) are set such that the directions of axes "a" of the hanger rods 10 are arranged in the direction along the front-to-back direction of the housing 2 (the Y direction in FIG. 2), that is, the axes "a" are arranged in the front-to-back direction.

Figure 5A:
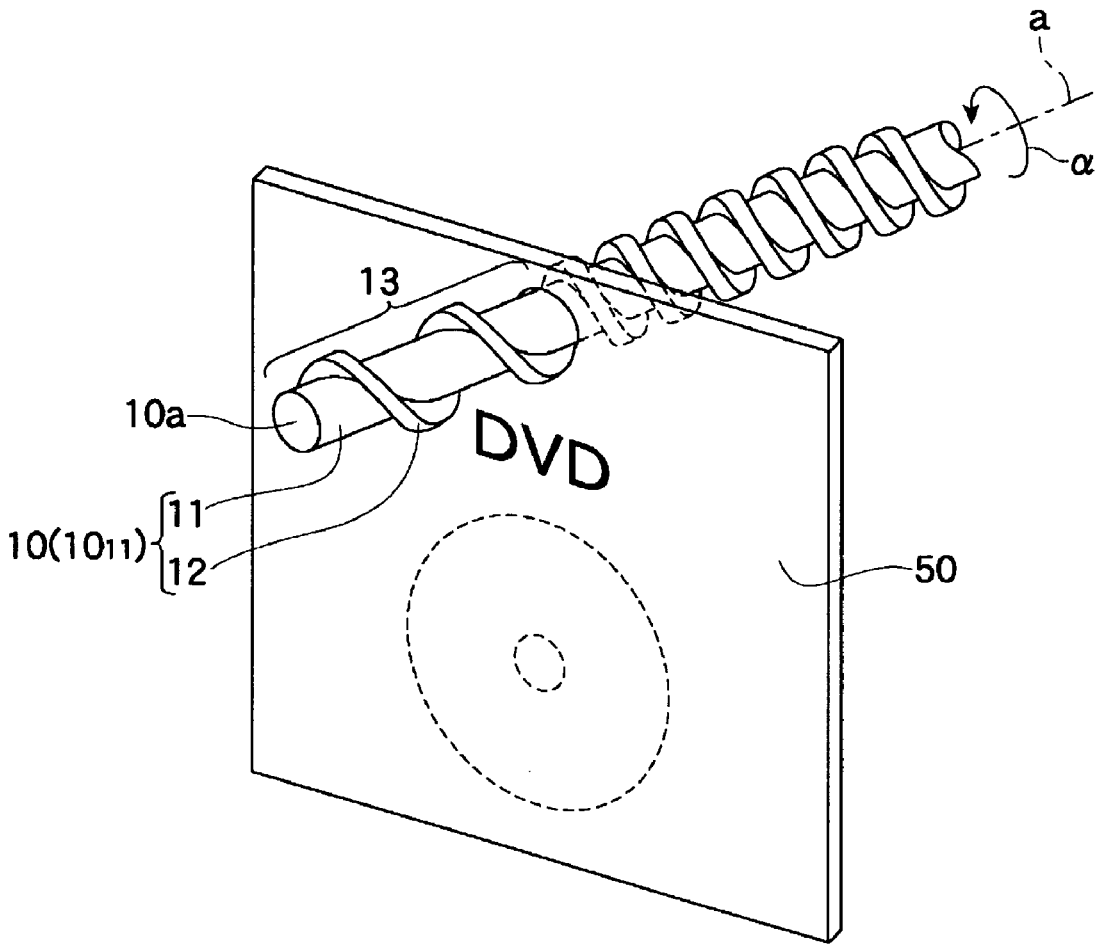
Figure 5B:
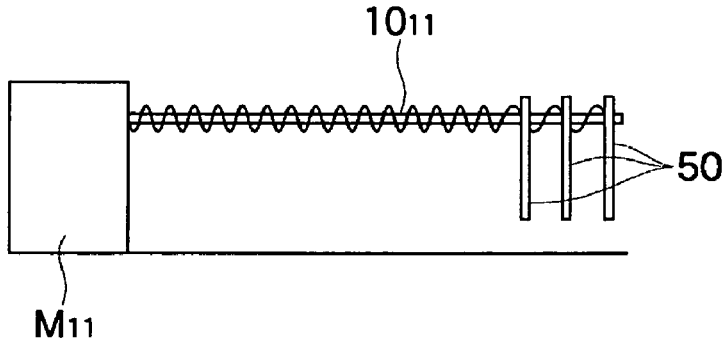

Further, each hanger rod 10 forms, as also shown in FIG. 5A, helical ridges 12 which extend helically or spirally along the axis "a" on a rod-like proximal portion 11 thereof. As shown in FIG. 5B, the commodities 50 are suspended from portions having no helical ridges 12 in the proximal portion 11 (the portions constituting helical grooves which extend spirally along the axes), wherein by rotating the hanger rod 12 about an axis (the direction "α" in FIG. 5A), it is possible to transfer or feed the commodities 50 by pushing the commodities 50 with the helical ridges 12. The helical ridges 12 are formed such that, by rotating the hanger rod 10 in the direction "α", the helical ridges 12 advance toward the open-end-portion-10*a* side and transfer the commodities 50. As shown in FIG. 4, the proximal portion 11 includes a notched portion 11*a* on a tip end thereof.

Further, each hanger rod 10 forms a pitch enlarged portion 13 which constitutes the technical feature of the present invention on an open-end-portion-10*a* side thereof. The pitch enlarged portion 13 is formed within a predetermined range from the open end portion 10*a*. In the pitch enlarged portion 13, an arrangement pitch in the direction along the axes "a" of the helical ridges 12 is enlarged and made wider than the corresponding arrangement pitch in other portions. In case of the hanger rod 10 of this embodiment, as shown in FIG. 4, the arrangement pitch L1 in the pitch enlarged portion 13 is set wider than the arrangement pitch L2 in other regions (L1>L2).

In the pitch enlarged portion 13, by taking a size of (a package) of the commodity 50 to be suspended into consideration, the arrangement pitch L1 is determined to a size which allows the commodity 50 to face the front by changing the direction of the commodity 50 while suspending the commodity 50. With the formation of the pitch enlarged portion 13, an interval between the helical ridges 12 is widened and hence, a space where the commodity 50 is suspended with a margin is formed whereby it is possible to easily change the direction of the commodity 50 while suspending the commodity 50.

Further, to change the direction of the commodity 50 suspended from the pitch enlarged portion 13, a rectifying unit 14 is provided to each one of hanger rod units U1 to U4. Each rectifying unit 14 has a size which allows an end portion of the commodity 50 to come into contact with the rectifying unit 14 and is arranged at a position where the commodity 50 which is positioned on a front most end of the hanger rod 10 is brought into contact with the rectifying unit 14 while being transferred or fed. With the provision of the rectifying unit 14, it is possible to rectify the direction of the commodity 50 (an angle of the commodity 50 with respect to the hanger rod 10) such that the commodity 50 faces the front of the housing 2. Here, each rectifying unit 14 may be deformed by deflection thereof when the end portion of the commodity 50 comes into contact with the rectifying unit 14.

As described above, according to this article transfer device 1, the pitch enlarged portion 13 is configured to have a pitch of a size which allows the commodities 50 to be suspended to change the directions thereof.

Due to such a constitution, it is possible to change the directions of the commodities 50 to be suspended in a state that the commodities 50 are not brought into contact with each other thus preventing the commodities 50 from being damaged.

Further, according to this article transfer device 1, the article transfer device 1 further includes the rectifying unit 14 which changes the directions of the commodities 50 to be suspended on the pitch enlarged portion 13 of each hanger rod 10 and rectifies the commodities 50 to face a front surface of the housing 2.

Since it is sufficient for the rectifying unit 14 to change only the directions of the commodities 50 to be suspended from the pitch enlarged portion 13, the structure is simple. Further, since the directions of the commodities which are suspended from the pitch enlarged portion 13 and are arranged close to the front surface of the housing 2 are changed, it is possible to easily observe the commodities 50 from the front surface of the housing 2.

Although three commodities 50 are suspended from the pitch enlarged portion 13 in the hanger rod 10 shown in the drawing (for example, three commodities 50*a*, 50*b*, 50*c* being suspended from the hanger rod $\mathbf{10}_{21}$), the pitch enlarged portion 13 may be formed such that the arrangement pitch from the open-end-portion-10*a*-side distal end to the second helical ridge 12 (12*a* or 12*b*) is enlarged. Further, although the arrangement pitch in the pitch enlarged portion 13 is set to the fixed value L1 in the hanger rod 10 shown in the drawing, the arrangement pitch may be changed such that the arrangement pitch is gradually enlarged toward the open-end-portion-10*a*-side distal end.

The helical ridges 12 may suitably change the length or the size of the arrangement pitch L2 in portions thereof other then the pitch enlarged portion 13 in conformity with the shape and the size of the commodity 50. By narrowing the arrangement pitch L2, the number of the helical ridges 12 is increased and hence, the larger number of the commodity 50 can be suspended. As an opposite case, by widening the arrangement pitch L2, the number of the helical ridges 12 is decreased and hence, the number of the commodity 50 which can be suspended becomes smaller.

Figure 6:
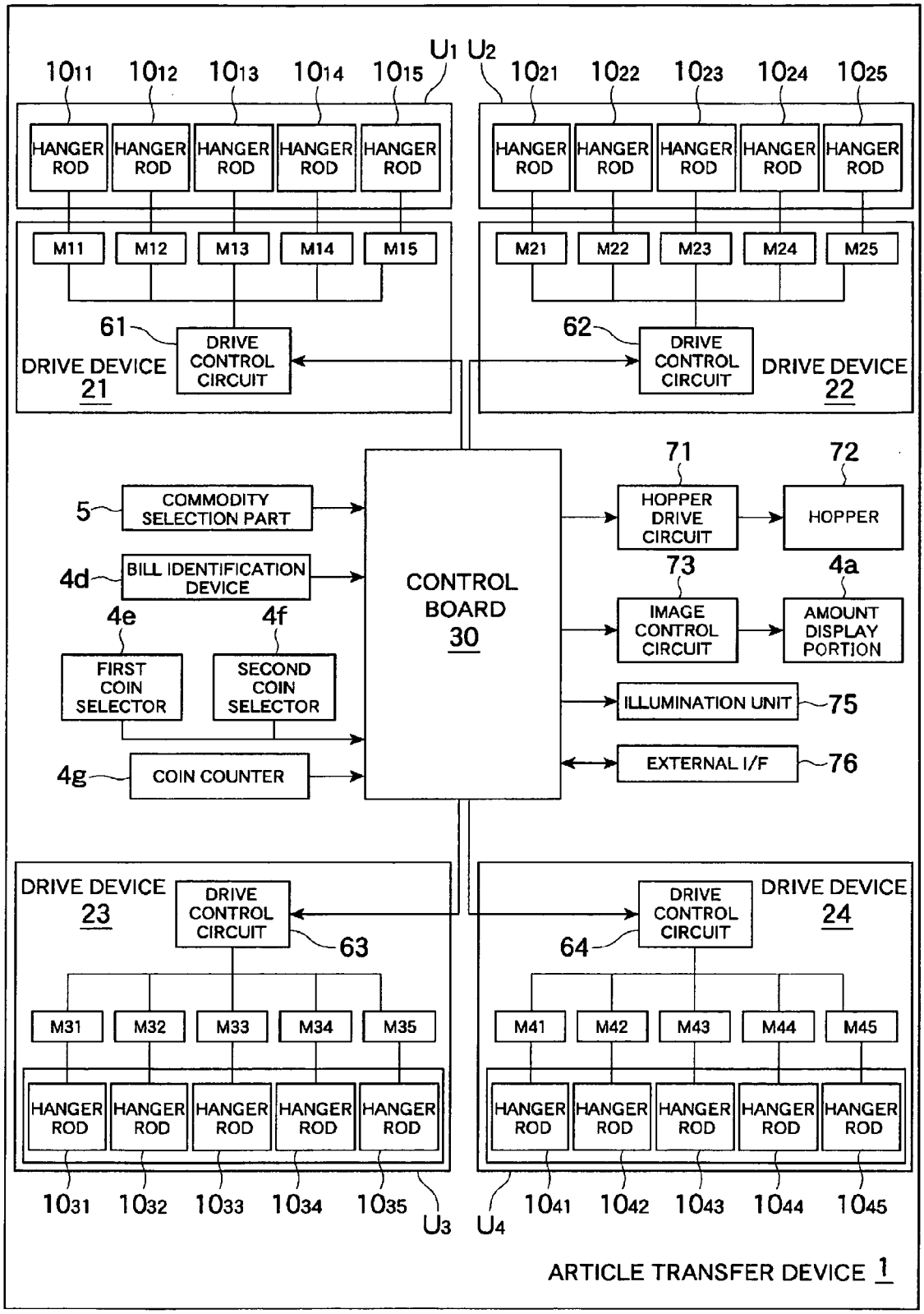
FIG. 6 is a block diagram showing the inner constitution of the article transfer device.

FIG. 6 is a block diagram showing the inner constitution of the article transfer device 1. The article transfer device 1 is mainly constituted of a control board 30 and includes a plurality of constitutional elements besides the above-mentioned constitutional elements.

The control board 30 constitutes a control unit according to the present invention and includes a CPU (Central Processing Unit), a RAM (Random Access Memory) and a ROM (Read Only Memory). The CPU is operated in accordance with a program stored in the ROM so as to perform the inputting and outputting of signals with other constitutional elements thus performing an operational control of the whole article transfer device 1. The RAM stores data and a program which are used when the CPU is operated, while the ROM stores a program which the CPU executes and permanent data.

Further, the article transfer device 1 includes the drive devices 21, 22, 23, 24. The respective drive devices 21 to 24 include supporter which support one-end sides of five hanger rods $10_{11}$ to $10_{15}$, five hanger rods $10_{21}$ to $10_{25}$, five hanger rods $10_{31}$ to $10_{35}$ and five hanger rods $10_{41}$ to $10_{45}$ provided to the respective hanger rod units U1 to U4 in a cantilever manner such that the hanger rods are rotatable about axes thereof, and the support drive parts M11 to M15, the support drive parts M21 to M25, the support drive parts M31 to M35 and the support drive parts M41 to M45 which include power parts such as motors, solenoids or the like for rotating the hanger rods about axes thereof and power transmission units such as gears, belts or the like. Further, the respective drive devices 21 to 24 include drive control circuits 61, 62, 63 and 64 respectively. The support drive parts M11 to M15, support drive parts M21 to M25, support drive parts M31 to M35 and support drive parts M41 to M45, upon receiving inputting of drive signals from the respective drive control circuits 61, 62, 63 and 64, rotate the respective hanger rods 10 about axes thereof by a predetermined angle. Upon receiving the inputting of control signals from the control board 30, the drive control circuits 61, 62, 63 and 64 output drive signals to the power parts such as motors of the support drive parts corresponding to the inputted control signals.

Further, the article transfer device 1 includes a bill identification device 4*d*, first and second coin selectors 4*e*, 4*f*, a coin counter 4*g*, a hopper drive circuit 71 and a hopper 72. The bill validation device 4*d* performs the genuineness determination and the denomination determination of the bills which are inserted through the bill insertion opening 4*b* and outputs a signal showing results of these determinations to the control board 30 and at the same time, includes a stocker (not shown in the drawing) which preserves the inserted bills. The first and second coin selectors 4*e*, 4*f* respectively perform the genuineness determination and the selection of coins inserted through the coin insertion opening 4*c*, and store the selected coins in the stockers. The coin counter 4*g* counts the number of coins corresponding to the selection and outputs a result of counting to the control board 30.

The hopper drive circuit 71 drives the hopper 72 in accordance with a control performed by the control board 30, wherein the hopper 72 performs an operation for paying out an amount of money corresponding to the change information inputted from the hopper drive circuit 71 and pays out the money from the change discharge part 6.

Further, the article transfer device 1 includes an image control circuit 73 which performs a control for displaying an image indicative of the inserted amount on the amount display portion 4*a*, an illumination unit 75 such as a cold cathode ray tube or the like which radiates light and brightens the inside of the commodity display part 3, and an external I/F unit 76 for performing the communication with an external equipment not shown in the drawing.

(Explanation of Manner of Operation of Article Transfer Device)

Next, contents of the manner of operation of the article transfer device 1 having the above-mentioned constitution are explained.

When the purchaser inserts an amount of money corresponding to a price of commodity into the bill insertion opening 4*b* or the coin insertion opening 4*c*, the article transfer device 1 is operated as follows.

The article transfer device 1 performs the determination of denomination and the genuineness of the inserted money using the bill validation device 4*d* or performs the determination of genuineness and the selection of the inserted coins using the first and second coin selectors 4*e*, 4*f*. Further, the coin counter 4*g* performs the counting of the number of coins. The money information indicative of these results is inputted into the control board 30. The control board 30 grasps the amount from the money information and instructs the image control circuit 73 to display an image indicative of the amount (for example, "¥5,000"). In accordance with the instruction of the image control circuit 73, the numbers of the inserted amount are displayed on the amount display portion 4*a*.

Next, the purchaser watches the commodities 50 in the inside of the commodity display part 3 from the outside and selects the desired commodity and, thereafter, decides the hanger rod 10 in which the commodity 50 which the purchaser desires is stored out of the hanger rod units U1 to U4 and the numbers 1 to 5. Then, to specify the commodity 50, the purchaser performs the inputting of manipulation by manipulating the commodity selection part 5. As the result, the selection information indicative of the selected hanger rod 10 is inputted to the control board 30 from the commodity selection part 5. The control board 30, based on the selection information, specifies the hanger rod unit U1 to U4 and the numbers, that is, the hanger rod 10 which suspends the commodity 50 which the purchaser selects (this specified hanger rod 10 constituting the selected hanger rod 10 according to the present invention), and an instruction signal is inputted to the drive control circuit corresponding to the selected hanger rod 10 out of the drive control circuits 61 to 64.

Then, any one of the drive control circuits 61 to 64 to which the instruction signal is inputted outputs a drive signal to the power part such as the motor or the like of the corresponding support drive part and hence, the power part such as the motor rotates the selected hanger rod 10 about an axis thereof. Then, due to the rotation of the selected hanger rod 10 which is connected to the support drive part about an axis thereof in the direction of $\alpha$, the helical ridge 12 transfers or feeds the commodity 50 and, as shown in FIG. 1, the commodity 50 which is suspended from the distal end is removed from the selected hanger rod 10 and falls downwardly in the inside of the housing 2 due to the gravity thereof (in this case, the commodity 50 being easily removed from the hanger rod 10 due to a notched portion 11*a* formed on the tip end of the proximal portion 11), and is stored in the commodity takeout part 8. The purchaser can take out the fallen commodity 50 from the commodity takeout part 8. Further, in response to the fall of the commodity 50 due to the rotation of the selected hanger rod 10, the change is calculated by the control board 30 and the hopper drive circuit 71 is instructed to pay out the money corresponding to the amount and hence, the change is paid out from the hopper 72.

In the above-mentioned case, while the article transfer device 1 includes the plurality of hanger rods 10, the respective hanger rods 10 form the pitch enlarged portions 13 on the open-end-portion-10*a* side as described above. Since the arrangement pitch in the pitch enlarged portion 13 is set larger than the arrangement pitch in other portions, the distance between the neighboring commodities 50 which are suspended becomes wide whereby the direction of the commodity 50 can be easily changed. Accordingly, when the commodity 50 is transferred by the helical ridge 12 and is positioned at the tip end of the hanger rod 10, the commodity 50 is brought into contact with the rectifying unit 14 and hence, the direction of the commodity 50 (that is, the angle which the commodity 50 makes with respect to the hanger rod 10) is changed whereby, as shown in FIG. 4, it is possible to direct the commodity 50 to face the front surface of the housing 2 (the commodity is directed in the direction of the face panel 2*a*). Further, there is no possibility that when the commodity 50 which is positioned at the tip end is almost removed from the selected hanger rod 10 and falls due to the gravity thereof, the commodity 50 is brought into contact with the succeeding commodity 50 and hence, the commodity 50 is not damaged.

Figure 9A:
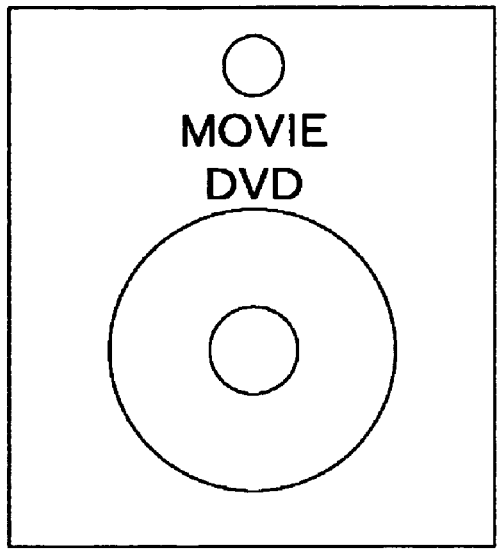
Figure 9B:
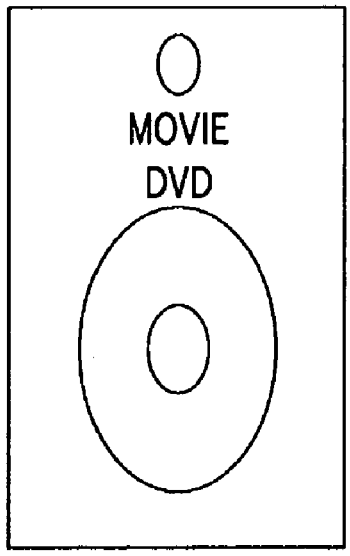

Accordingly, as shown in FIG. 9A, when the article transfer device 1 is observed from the front surface of the housing 2, the suspended commodity 50 which is positioned at the tip end portion of the hanger rod 10 appears to directly face the front surface of the housing 2. To the contrary, in the conventional article transfer device (vending machine), as shown in FIG. 9B, the commodity is directed in the oblique direction with respect to the face panel.

As can be understood from the comparison of these two article transfer devices, the article transfer device 1 according to this embodiment can direct the suspended commodity to directly face the front surface of the housing 2 and hence, the commodity can be easily observed from the outside.

In addition to the above-mentioned advantageous effect, the pitch enlarged portion 13 is formed only on the open-end-portion-10*a* side and the arrangement pitch of other portion is set narrower than the arrangement pitch of the pitch enlarged portion 13 and hence, it is possible to ensure the sufficient number of commodities which can be suspended from the hanger rod 10 at the portions of each hanger rod 10 where the pitch enlarged portion 13 is not formed. That is, even when the pitch enlarge portion 13 is formed, it is possible to ensure the sufficient number of commodities which can be suspended from the hander rods 10 and hence, it is unnecessary to elongate a length of the hanger rods 10 whereby it is unnecessary to increase a depth of the housing 2.

In the above-mentioned article transfer device 1, four hanger rod units U1 to U4 are provided for one set of manipulation panel 7 and each unit has five hanger rods 10. However, in the article transfer device 1, the number of hanger rod units is not limited to four and can be increased or decreased and, at the same time, the number of hanger rods 10 in the inside of each unit can be also increased or decreased.

Further, as mentioned above, it is unnecessary to provide the power parts such as motors for the respective hanger rods 10 in each unit and the respective hanger rods 10 in each unit may be driven using a single motor or the like.

Figure 7:
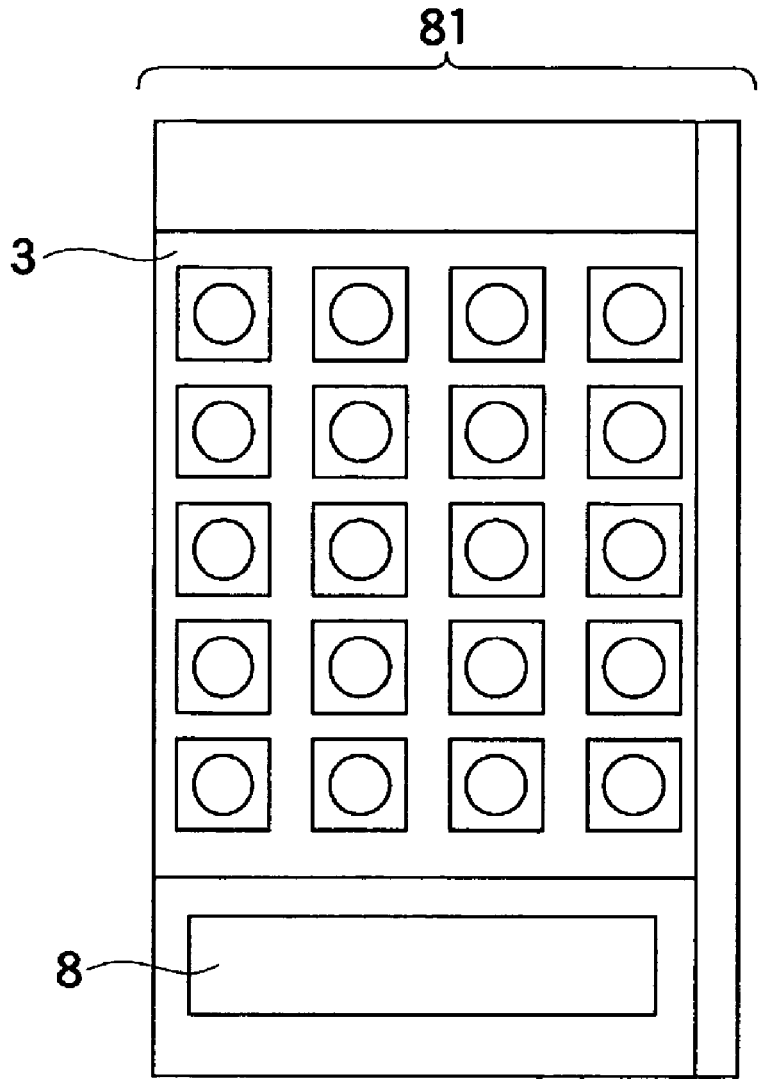
FIG. 7 is a front view showing an expansion unit of the article transfer device.
Figure 10:
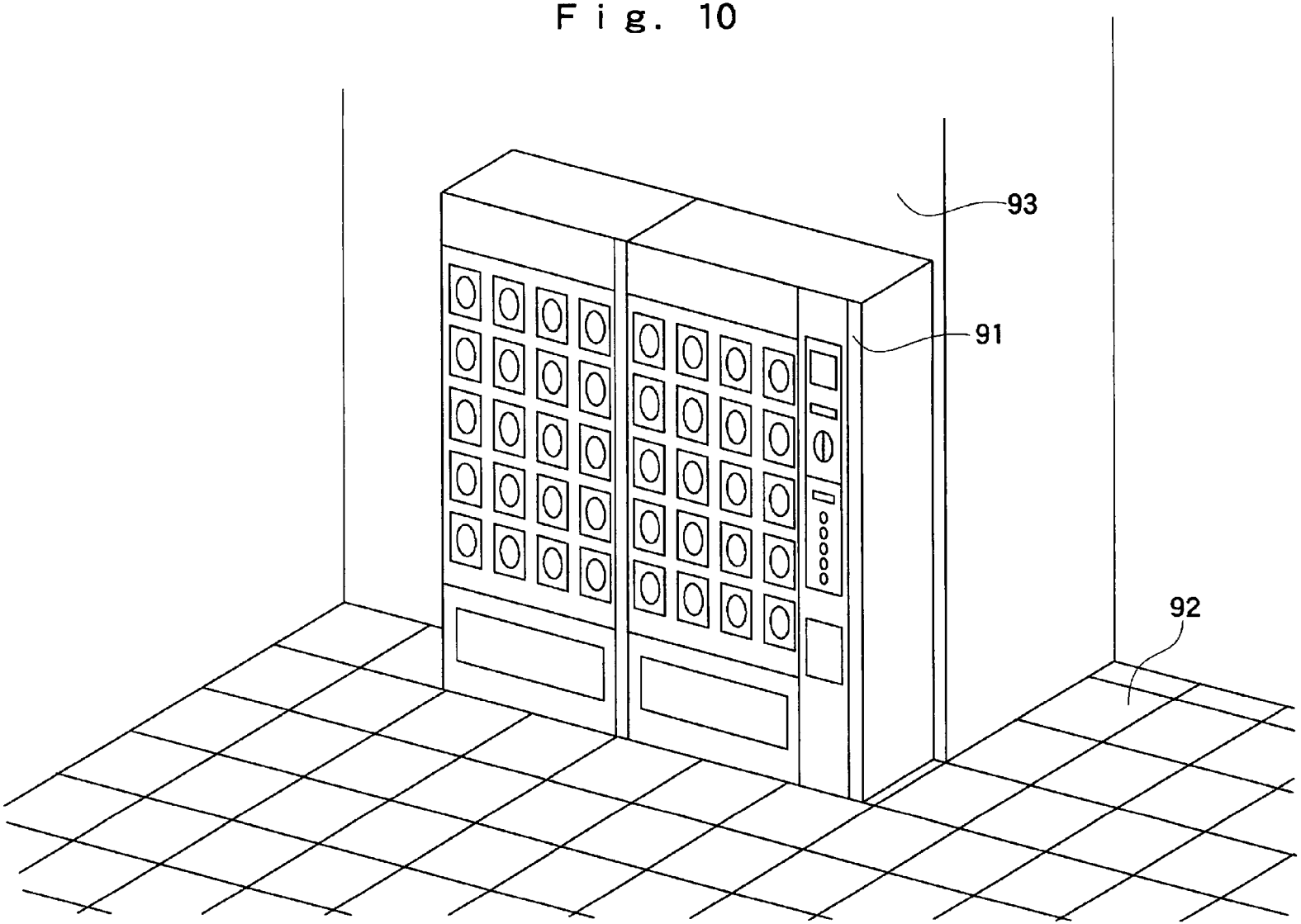
FIG. 10 is a perspective view showing one example of a mounting state of the article transfer device to which an expansion unit is additionally provided.

In this case, it is sufficient to provide one set of the manipulation panel 7 with respect to all hanger rods 10. For example, using the article transfer device 1 shown in FIG. 3 as a basic unit 80 and providing an expansion unit 81 having no manipulation panel 7 as shown in FIG. 7, an arbitrary number of expansion units 81 may be additionally installed on the basic unit 80. For example, as shown in FIG. 10, an article transfer device 91 may be provided by additionally installing one expansion unit 81 to the basic unit 80 and the article transfer device 91 may be mounted on a floor surface 92. Also in this case, in the article transfer device 91, the respective hanger rods 10 have the pitch enlarged portions 13 and hence, it is possible to direct the commodities to face the front surface of the housing such that the commodities are not damaged without increasing a depth of the article transfer device 91.

Figure 8A:
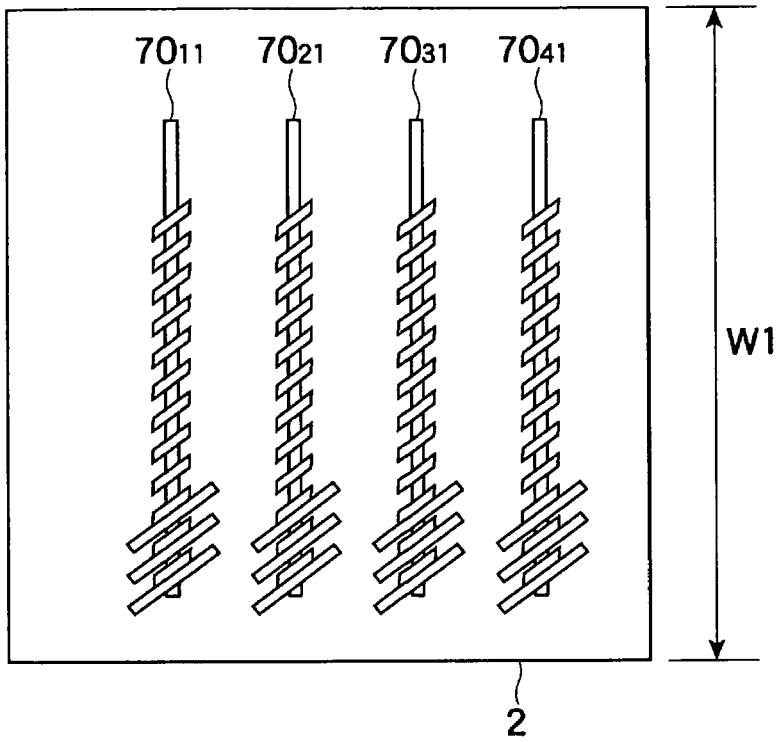
Figure 8B:
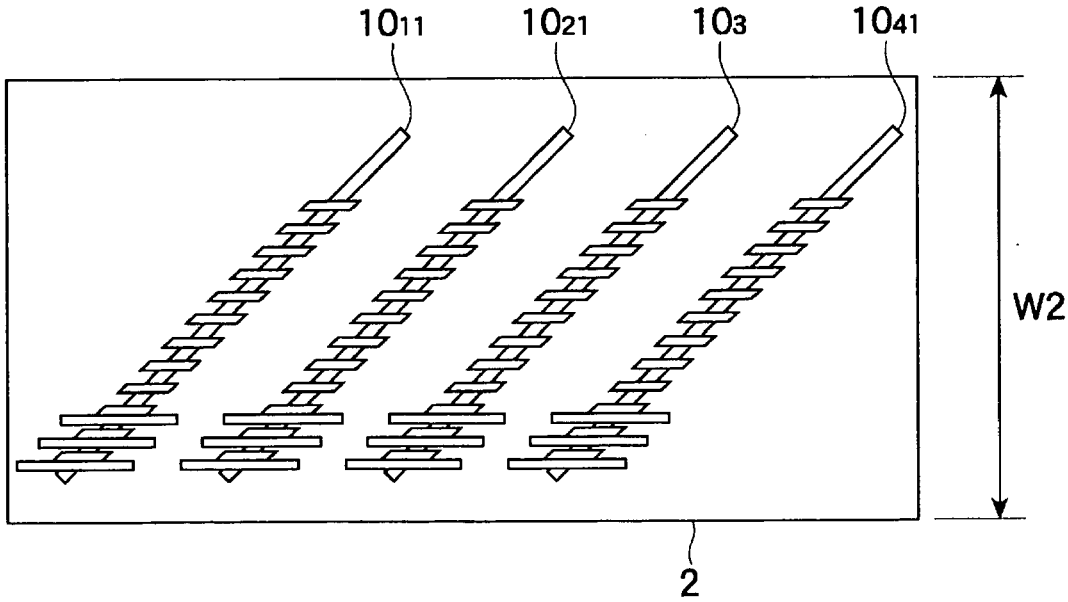

Further, the article transfer device 1 maybe arranged such that the axes of the respective hanger rods 10 are set obliquely with respect to the front to rear direction. In this case, for example, to compare a depth W1 of the housing 2 when the respective hanger rods 10 are arranged parallel to the front-to-rear direction of the housing as shown in FIG. 8A and a depth W2 of the housing 2 when the axes of the hanger rods 10 are set obliquely with respect to the front to rear direction as shown in FIG. 8B, it is possible to narrow (shorten) the depth W2 of the housing 2 in the latter case (W1>W2). Accordingly, the article transfer device 1 can not only ensure the sufficient number of commodities 50 which can be suspended from the hanger rods 10 but also can reduce a thickness of the housing 2 by narrowing the depth W2 of the housing 2 whereby it is possible to prevent the projection of the article transfer device 1 from a wall surface of an installation site of the article transfer device 1.

Further, in the article transfer device 1, since the axes of the respective hanger rods 10 are set obliquely with respect to the front-to-rear direction, the helical ridge 12 (a side wall portion of the helical ridge 12) is directed to face the face panel 2*a* and hence, the commodities 50 which are suspended from the hanger rods 10 are also directed toward the face panel 2*a*.

In the above-mentioned article transfer device 1, the explanation has been made with respect to the case in which the commodity selection part 5 includes the unit designation part 5*a* and the number designation part 5*b*. However, the commodity selection part 5 may have an input key which individually inputs numbers from 0 to 9.

In place of the money inputting part 4, it is possible to use a card reader/writer which reads and writes a prepaid card or a credit card and inputs the money information into the control board 30. Alternatively, it is possible to use means which performs the radio transmission/reception with a mobile communication means having the radio communication function of money information such as a mobile phone or the like and to input the money information to the control board 30.

Figure 11:
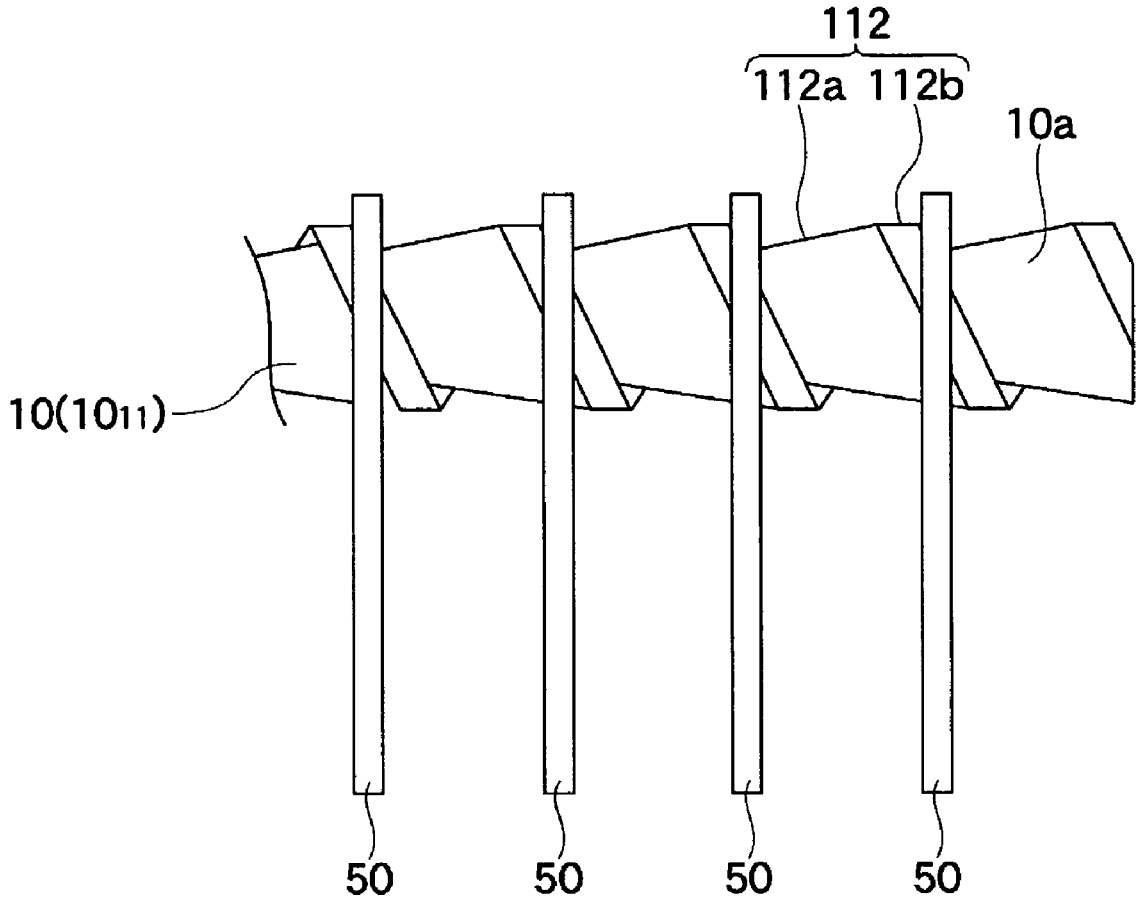
FIG. 11 is a view showing another hanger rod and the side view of the commodity suspended from another hanger rod.

Further, the hanger rod 10 may, as shown in FIG. 11, include inclined helical ridges 112 which are constituted of helical ridges 112*a* similar to the helical ridges 12 and inclined portions 112*b* each of which is inclined toward the open-end portion 10*a* between respective helical ridges 112*a* along the surface of the distal end portion 11. By forming such inclined helical ridges 112 on the hanger rod 10, the suspended commodities 50 are moved toward the support end portion 10*b* side along the inclined portions 112*b* due to the own weight whereby the commodities 50 are easily arranged along the respective helical ridges 112*a*. Accordingly, it is possible to easily hold the distance between the respective commodities 50 to a given size.

Although the article transfer device 1 has been explained as the vending machine which sells suspended commodities, the present invention is applicable to a device which displays commodities in a suspended manner.

What is claimed is:

1. An article transfer device comprising:

a plurality of hanger rods, each of the hanger rods having a length sufficient for suspending a plurality of articles from the hanger rod, helical ridges or helical grooves which spirally extend along an axis of the hanger rod, on a surface of the hanger rod, and a pitch enlarged portion where pitch of the helical ridges or the helical grooves is larger than pitch of the helical ridges or the helical grooves in other portions of the hanger rod, the pitch enlarged portion being located proximate an unsupported open end of the hanger rod;

a supporter which supports the respective hanger rods at closed ends of the hanger rods, opposite the open ends, so that the hanger rods are rotatable about respective axes of the hanger rods;

a driver which rotates the hanger rods about respective axes of the hanger rods;

a housing containing the hanger rods, the supporter, and the driver; and a rectifying unit which changes direction of the articles suspended on the pitch enlarged portion of each hanger rod and rectifies the articles to face a front surface of the housing.

2. The article transfer device according to claim 1, wherein the article transfer device further includes a selection unit which selects any one of the hanger rods; and a control unit which operates the driver corresponding to a hanger rod selected so that the hanger rod, which is selected by the selection unit, is rotated about the axis of the hanger rod selected.

3. An article transfer device comprising:

a plurality of hanger rods, each of the hanger rods having a length sufficient for suspending a plurality of articles from the hanger rod, helical ridges or helical grooves which spirally extend along an axis of the hanger rod, on a surface of the hanger rod, and a pitch enlarged portion where pitch of the helical ridges or the helical grooves is larger than pitch of the helical ridges or the helical grooves in other portions of the hanger rod, the pitch enlarged portion being located proximate an unsupported open end of the hanger rod, the pitch enlarged portion having a pitch sized so that the articles suspended from the hanger rod may change direction;

a supporter which supports the respective hanger rods at closed ends of the hanger rods, opposite the open ends, so that the hanger rods are rotatable about respective axes of the hanger rods;

a driver which rotates the hanger rods about respective axes of the hanger rods;

a housing containing the hanger rods, the supporter, and the driver; and a rectifying unit which changes direction of the articles suspended on the pitch enlarged portion of each hanger rod and rectifies the articles to face a front surface of the housing.

4. The article transfer device according to claim 3, wherein the article transfer device further includes a selection unit which selects any one of the hanger rods; and a control unit which operates the driver corresponding to a hanger rod selected so that the hanger rod, which is selected by the selection unit, is rotated about the axis of the hanger rod selected.

* * * * *